US005977862A

United States Patent [19]

Pham

[11] Patent Number: 5,977,862

[45] Date of Patent: Nov. 2, 1999

[54] POLYMER HIGH VOLTAGE CURRENT LIMITERS PACKAGED IN SERIES

[75] Inventor: Van Doan Pham, Meyzieu, France

[73] Assignee: GEC Alsthom T & D SA, Paris, France

[21] Appl. No.: 08/840,621

[22] Filed: Apr. 25, 1997

[30] Foreign Application Priority Data

Apr. 26, 1996 [FR] France ..... 96 05 304

[51] Int. Cl.[6] ..... H01C 1/02

[52] U.S. Cl. ..... 338/260; 338/320; 338/22 R; 338/295; 361/9; 361/106

[58] Field of Search ..... 338/319, 320, 338/22 R, 201, 295, 239, 260; 361/3, 58, 106

[56] References Cited

U.S. PATENT DOCUMENTS

| | | | |
|---|---|---|---|
| 649,388 | 5/1900 | Wurts | 338/319 |
| 2,769,071 | 10/1956 | Ward | 338/22 R |
| 2,988,722 | 6/1961 | Zabel | 338/239 |
| 3,213,402 | 10/1965 | Tassara | 338/260 |
| 3,249,810 | 5/1966 | Strom et al. | 361/3 |
| 3,340,382 | 9/1967 | Lennox | 219/544 |
| 3,543,002 | 11/1970 | Poole | 392/432 |
| 3,935,509 | 1/1976 | Edinger | 361/3 |
| 4,352,083 | 9/1982 | Middleman et al. . | |
| 4,400,614 | 8/1983 | Sopory . | |
| 4,475,138 | 10/1984 | Middleman et al. | 361/58 |
| 4,560,524 | 12/1985 | Smuckler . | |
| 4,733,057 | 3/1988 | Stanzel et al. | 219/548 |
| 4,780,598 | 10/1988 | Fahey et al. | 219/511 |
| 4,859,836 | 8/1989 | Lunk et al. | 219/548 |
| 4,876,440 | 10/1989 | Kamath et al. | 219/548 |
| 4,884,163 | 11/1989 | Deep et al. | 361/58 |
| 4,967,176 | 10/1990 | Horsma et al. | 338/22 R |
| 5,247,277 | 9/1993 | Fang et al. | 338/22 R |
| 5,379,022 | 1/1995 | Bacon et al. | 338/20 |
| 5,737,160 | 4/1998 | Duffy | 361/3 |

FOREIGN PATENT DOCUMENTS

| | | |
|---|---|---|
| 0461864A1 | 12/1991 | European Pat. Off. . |
| 2506067 | 11/1982 | France . |

*Primary Examiner*—Michael L. Gellner
*Assistant Examiner*—Karl Easthom
*Attorney, Agent, or Firm*—Sughrue, Mion, Zinn, Macpeak & Seas, PLLC

[57] ABSTRACT

A polymer high voltage current limiter comprising, per phase, a fast circuit-breaker pole, a semi-fast protection circuit-breaker pole, and a set of polymer-based elements having very low resistivity, filled with carbon black, and connected in series and in parallel, wherein each element comprises a carbon-filled polymer matrix of elongate shape and including in its interior two parallel metal conductors.

8 Claims, 2 Drawing Sheets

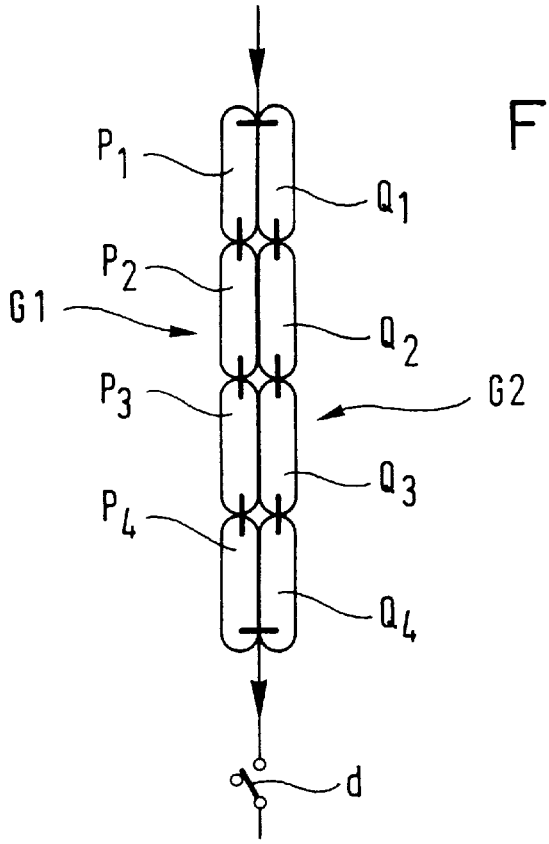
FIG. 3
FIG. 4
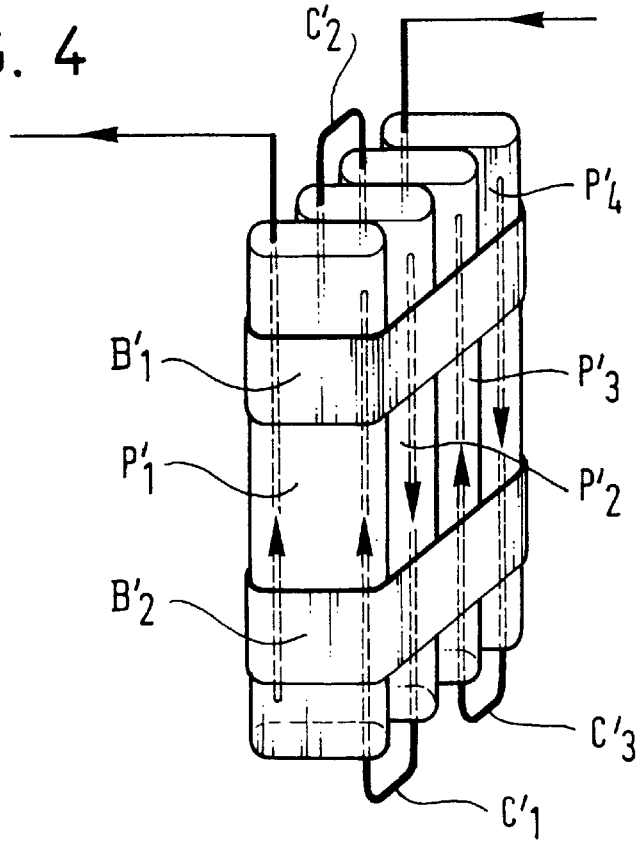

POLYMER HIGH VOLTAGE CURRENT LIMITERS PACKAGED IN SERIES

The present invention relates to a polymer high voltage current limiter.

BACKGROUND OF THE INVENTION

In French patent application No. 95/10662 of Sep. 12, 1995, the Applicant describes a polymer current limiter comprising at least one stack of a plurality of stages of linear resistance elements and of polymer variable resistance elements, wherein each stage is constituted by a linear resistance in the form of a disk around which there are connected in parallel pellet-form polymer elements, the transverse axes of said pellets being perpendicular to the axis of the stack.

The polymer elements are small in size and above all small in thickness, and they possess metal tabs soldered to each face thereof with the ends thereof being soldered to a current collector.

That device, which requires a large number of solder joints or electrical connections, is expensive and it is not sufficiently robust.

Also, each element has its own relatively high capacitance. This gives rise to a large amount of capacitance per stage, which means that it is possible to unbalance the distribution of voltage between stages.

OBJECTS AND SUMMARY OF THE INVENTION

An object of the present invention is to design a polymer current limiter that is robust in structure, that requires only a very small number of electrical connections or solder joints, and that has low overall capacitance.

The invention provides a polymer high voltage current limiter comprising, per phase, a fast circuit-breaker pole, a semi-fast protection circuit-breaker pole, and a set of polymer-based elements having very low resistivity, filled with carbon black, and connected in series and in parallel, wherein each element comprises a carbon-filled polymer matrix of elongate shape and including in its interior two parallel metal conductors.

Advantageously, the matrix is oblong in section.

Preferably, the matrix is surrounded by a sheath of insulating material.

In a preferred embodiment, the sheath material is a fluoro-polymer.

In a first specific embodiment of the invention, the two conductors of an element open out via the same end from the matrix, and a group of series-connected elements is made up of by an assembly of elements disposed side by side and in contact in pairs via the small sides of their side surfaces, and interconnected by connections all disposed at the same end of the assembly.

In a second specific embodiment of the invention, the two conductors of an element open out from the matrix at respective opposite ends, and a group of elements connected in series is constituted by an assembly of elements disposed side by side in contact in pairs via the large sides of their side surfaces and interconnected by connections disposed alternately at opposite ends of the assembly.

According to a characteristic of the invention, the electrical resistivity of the carbon black filled polymer is about 1 ω.cm.

Preferably, the length of an element is of the order of 1000 mm.

Preferably, the distance between the parallel conductors of an element is of the order of 10 mm.

BRIEF DESCRIPTION OF THE DRAWINGS

Various embodiments of the invention are described below with reference to the accompanying drawings, in which:

FIG. 3 shows two groups of polymer elements connected in parallel; and

FIG. 4 shows another organization of a group of polymer elements used in a current limiter of the invention.

MORE DETAILED DESCRIPTION

Figure 1:
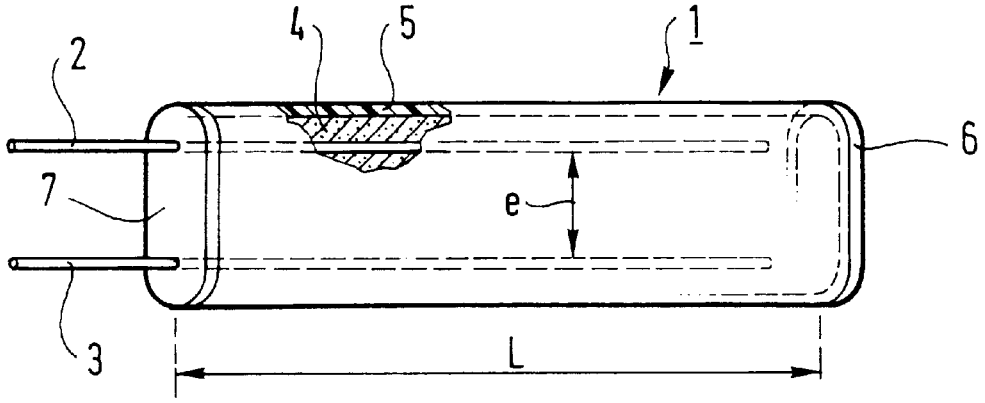
FIG. 1 is a perspective view of a polymer element used in the current limiter of the invention.

In FIG. 1, reference 1 designates a polymer element used in making the current limiter of the invention. This element comprises two parallel conductors 2 and 3, preferably made of tinned copper, in the form of a braid or of a rod. The conductors are coated in a matrix 4 of a polymer (polyethylene) filled with carbon black; the matrix is protected by an insulating sheath 5, e.g. a fluoro-polymer, that provides good mechanical and dielectric strength. The matrix is closed at both ends by respective insulating plugs 6 and 7. Inside the matrix, the conductors are of length L and they are spaced apart by a distance e. At one of the ends of the element, the conductors 2 and 3 pass through the corresponding end plug (plug 7 in FIG. 1).

The electrical resistivity of the carbon black filled polymer is about 1 ω.cm for a compound comprising 50% by weight polymer and 50% by weight carbon black.

The section of the matrix is preferably oblong, thereby enabling the bulk of the appliance to be kept down.

By way of example:

the distance e between the two conductors 2 and 3 is 10 mm;

the diameter of the conductor is 2 mm;

the length L of each conductor inside the matrix is 1000 mm; and the maximum thickness of the element is 5 mm, so that the electrical resistance of one polymer element is 50 mω.

Figure 2:
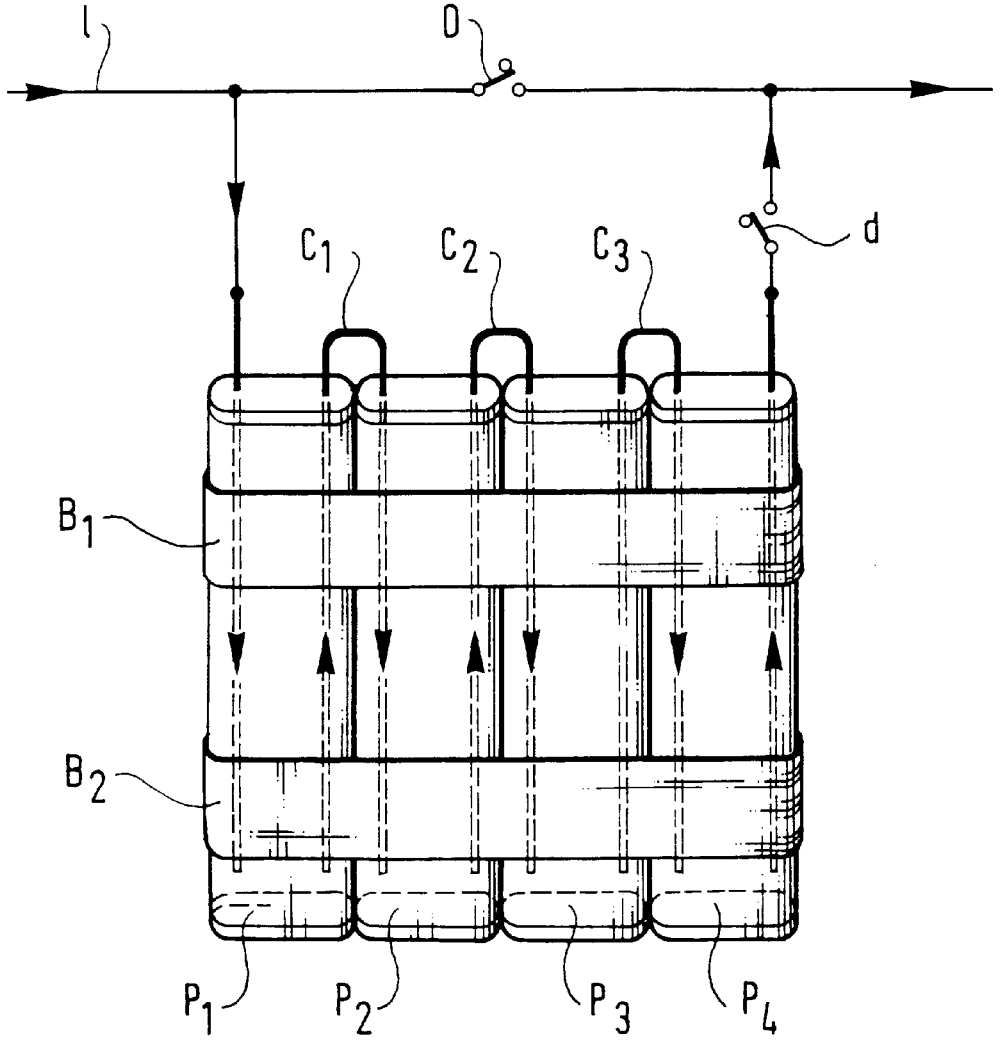
FIG. 2 is a diagrammatic view of a current limiter constituting a first embodiment of the invention.

FIG. 2 shows one pole of a current limiter of the invention as inserted on a phase l of the line to be protected.

The pole of the current limiter comprises a pole of a fast-acting circuit-breaker D connected in series in the line l, and in parallel with the terminals of the circuit-breaker, a set comprising a series connection of a semi-fast circuit-breaker d, and a plurality of polymer elements of the above-described type connected in series and referenced $P_1$ to $P_4$.

The elements are disposed side by side and they are in contact in pairs via the small sides of their insulating surfaces.

The elements $P_1$ to $P_4$ are connected in series by metal connections $C_1$ to $C_3$ which are all on the same end. In the two conductors of any given element, currents flow in opposite directions.

The set of elements $P_1$ to $P_4$ is rigidly held together by insulating tapes $B_1$ and $B_2$. The set is preferably located in an insulating enclosure (not shown) filled with a dielectric gas such as nitrogen at atmospheric pressure, and provided with current feedthroughs.

A current limiter for a line having a nominal voltage of 24 kV will have 20 groups of elements connected in parallel, each group of elements comprising 20 polymer elements connected in series.

The current limiter operates as follows:

when the line is operating in normal manner, the circuit-breakers D and d are closed. All of the nominal current flows through the circuit-breaker D because of the high resistance of the set of polymer elements compared with the contact resistance between the contacts of the circuit-breaker.

If a fault occurs, the circuit-breaker D opens very quickly. Current ceases to flow through the circuit-breaker D, and is diverted through the set of elements $P_1$ to $P_4$.

This current causes the polymer elements to heat up very quickly (e.g. within one or two milliseconds) and the electrical resistance thereof increases by a factor that may be as much as 100 times above a certain threshold temperature, e.g. 110° C. This sudden increase in the resistance of the group of polymer elements makes it possible to limit the fault current.

The residual current is broken by the circuit-breaker d which opens 20 ms after the appearance of the fault, for example.

FIG. 3 shows how two groups G1 and G2 of four elements $P_1$ to $P_4$ and $Q_1$ and $Q_4$ are connected in parallel.

FIG. 4 shows a variant embodiment in which the currents flow in the same direction in the two conductors in each polymer element. For this purpose, the two conductors of a given element open out from the matrix via respective opposite ends. FIG. 4 shows an assembly of four elements $P'_1$, $P'_2$, $P'_3$, and $P'_4$ disposed side by side and in contact in pairs via the large sides of their side surfaces. The connections $C'_1$, $C'_2$, and $C'_3$ are no longer all at the same end, but are alternately at opposite ends. References $B'_1$ and $B'_2$ designate insulating tapes holding the elements together.

I claim:

1. A polymer high voltage current limiter comprising:

a first circuit breaker pole;

a second circuit breaker pole; and a plurality of insulated polymer-based elements connected in series with each other and with said second circuit breaker pole and in parallel with said first circuit breaker pole, said polymer-based elements each including a polymer matrix filled with carbon black and a pair of metal conductors extending longitudinally within said matrix and laterally spaced from each other, adjacent conductors of adjacent elements being electrically connected to each other. wherein adjacent elements abut each other to form a compact package of elements, wherein the rate at which said second circuit breaker pole opens is slower than the rate at which said first circuit breaker pole opens, and wherein the pair of conductors protrude from opposite ends of the matrix, respectively.

2. A limiter according to claim 1, wherein the matrix has an oblong cross-sectional shape.

3. A limiter according to claim 3, wherein the sheath material is a fluoro-polymer.

4. A limiter according to claim 1, wherein the electrical resistivity of the carbon black filled polymer is about 1 ω.cm.

5. A limiter according to claim 1, wherein the length of an element is of the order of 1000 mm.

6. A limiter according to claim 1, wherein the distance between the parallel conductors of an element is 10 mm.

7. A limiter according to claim 1, wherein each said elements has an oblong cross-sectional shape with short sides and wherein, the short sides of each said pair abut one another.

8. A limiter according to claim 1, wherein each said element has an oblong cross-sectional shape with opposing short and long sides and wherein said elements are arranged side-by-side so that adjacent elements abut along the long sides, said elements being connected in series with connections being alternately arranged at opposite ends of said elements.

* * * * *